US010293889B2

(12) United States Patent
Hey et al.

(10) Patent No.: US 10,293,889 B2
(45) Date of Patent: May 21, 2019

(54) AUTOMATIC WATERCRAFT COVER

(71) Applicant: Sunstream Corporation, Kent, WA (US)

(72) Inventors: Kenneth Edwards Hey, Mercer Island, WA (US); Loern Alan Halverson, Bellevue, WA (US); Dean Allen Stanford, Seattle, WA (US)

(73) Assignee: Sunstream Corporation, Kent, WA (US)

( * ) Notice: Subject to any disclaimer, the term of this patent is extended or adjusted under 35 U.S.C. 154(b) by 0 days.

(21) Appl. No.: 15/596,870

(22) Filed: May 16, 2017

(65) Prior Publication Data

US 2017/0327188 A1 Nov. 16, 2017

Related U.S. Application Data

(60) Provisional application No. 62/337,307, filed on May 16, 2016.

(51) Int. Cl.
*B63B 17/02* (2006.01)
*B65H 37/00* (2006.01)

(52) U.S. Cl.
CPC ..... *B63B 17/02* (2013.01); *B65H 37/00* (2013.01)

(58) Field of Classification Search
CPC ..... B63B 17/02; B65H 37/00; B60J 7/085
USPC ..... 114/361
See application file for complete search history.

(56) References Cited

U.S. PATENT DOCUMENTS

| | | | | |
|---|---|---|---|---|
| 3,549,198 | A | 12/1970 | Cappello | |
| 4,019,212 | A | 4/1977 | Downer | |
| 5,269,332 | A | 12/1993 | Osborne | |
| 5,292,169 | A | 3/1994 | O'Brian | |
| 5,813,360 | A | 9/1998 | Dickey, Jr. | |
| 5,908,264 | A | 6/1999 | Hey | |
| 6,338,521 | B1 * | 1/2002 | Henning | B60J 7/085 296/100.14 |
| 6,742,828 | B2 * | 6/2004 | Smith | B60J 7/085 296/98 |
| 6,786,171 | B1 | 9/2004 | Elbers | |
| 7,001,104 | B2 | 2/2006 | Edson | |
| 7,350,846 | B2 * | 4/2008 | Smith | B60J 7/085 296/100.01 |
| 8,291,810 | B2 | 10/2012 | Hey et al. | |
| 8,911,174 | B2 | 12/2014 | Hey et al. | |
| 2015/0321730 | A1 | 11/2015 | Hey et al. | |

* cited by examiner

*Primary Examiner* — Anthony D Wiest
(74) *Attorney, Agent, or Firm* — George C. Rondeau, Jr.; Davis Wright Tremaine LLP

(57) ABSTRACT

A watercraft lift with hydraulically actuated arms which self-installs a fitted three-dimensional watercraft cover on a powerboat. A mechanism enables a linear actuator to drive a swing arm up to 180 degrees. The upper end of a two part arm articulates mechanically as the arm moves to reduce vertical elevation while operating. A spring-tensioned elongated roller keeps the cover tight and self-rolls the cover on the elongated roller when the actuated arms are pivoted forward. The mechanism can be attached to the guides of most watercraft lifts.

13 Claims, 15 Drawing Sheets

AUTOMATIC WATERCRAFT COVER

CROSS REFERENCE TO RELATED APPLICATION(S)

This application claims the benefit of U.S. Provisional Patent Application No. 62/337,307, filed May 16, 2016, entitled Universal Automatic Boat Cover.

BACKGROUND OF THE INVENTION

Field of the Invention

The present invention relates to watercraft covers for use with watercraft lifts, watercraft trailers, watercraft storage, vehicles and mechanical devices.

Description of the Related Art

The use of watercraft covers to protect watercrafts is well known. A number of designs are currently known to perform this basic operation. Many watercrafts have multi-section covers, often with one covering the bow section and another covering the aft section. The covers are typically shaped to cover at least portions of the three-dimensional shape of a watercraft and are manually spread out over the watercraft and then manually attached using snap or other fasteners. The bow section is attached with fasteners around the perimeter of the bow section especially when there is a bow opening. The aft section is attached to fasteners on the windshield frame, or in front of the windshield, as well with fasteners around the perimeter of the aft section. This common cover system has several negative aspects for the user. The large number of snaps or other fasteners used make the covers time consuming to install. The covers are often difficult to install after the cover material ages. The covers are large and awkward to store on-board. The covers can be dirty, and unpleasant to handle. The covers tend to lose shape, causing pockets of water, which further cause a loss of shape and pools of water. The covers do not cover a significant amount of hull surface surrounding the covers, and do not cover significant portions of the sides of the watercraft with which used, which causes fading in the sun of the uncovered portions of the watercraft and does not protect these areas from dirt. The covers provide no security, which makes the contents of the watercraft and the watercraft itself vulnerable to theft.

U.S. Pat. No. 8,911,174 solves many of these problems by having a mechanism automatically installing a three dimensional cover. This design is for use on a free-standing watercraft lift, and has much of the mechanism installed underwater. The arm of this design swings high above the watercraft, which limits the use under boat house roofs. The underwater structure requires a diver to install and service. The required cover mechanism structure under the boat also prevents it from being used on many types of watercraft lifts.

Several two-dimensional automatic cover designs are currently known. U.S. Pat. No. 3,549,198 uses a rotating arm to pull a flat cover over the top of a dump truck to secure the contents. This design would not be ideal for use with a watercraft lift since the cover is two-dimensional, non-adjustable and would be impractical to fit the three-dimensional shapes of various watercraft types with which the lift might be used.

It is known to use a two dimensional cover design similar to the one of the U.S. Pat. No. 3,549,198 for application on a portable watercraft lift with a pontoon boat. As such, the design does not provide protection to the sides of the boat. It also is more vulnerable to side wind, since it has exposed edges that catch the wind. Both designs use a roller fixed to the front, and a set of arms which pull the cover rearward like a window shade. This type of design is undesirable for an application on a boat, since the cover slides over parts of the boat, causing cover wear, and potential boat damage. The fixed cover in the front also blocks views and is not attractive since the roller remains visible at the front even when the cover is deployed. Pulling the cover from a fixed roller in the front also can cause damage to the cover and watercraft by dragging the cover on the watercraft. Further, the lift with the cover similar to the U.S. Pat. No. 3,549,198 does not provide any protection against operation of the lift when the cover is deployed, which can cause cover or watercraft damage, especially if installed on lifts that translate rearward when lowering, such as the lift of U.S. Pat. No. 5,908,264. Since the lift with the cover similar to the U.S. Pat. No. 3,549,198 patent is not remote controlled, another drawback is that the user is required to operate it from the location of a control box. It is desirable to be able to manually adjust the cover when operating in case it is not seating correctly.

U.S. Patents such as U.S. Pat. Nos. 4,019,212 and 6,786,171 describe a cover system that does not touch the watercraft. These systems have a fixed roof with structure and retractable sides that completely surround the watercraft. The tall sides of these systems block views and are more vulnerable to wind. For use on a free-standing or free-floating watercraft lift, the fixed roof structure can make the lift vulnerable to tipping. Because of the fixed roof, these systems often require permitting and are highly regulated.

U.S. Pat. No. 4,019,212 is a device that attaches to a free-standing watercraft lift and lifts the cover off vertically. This design requires an external frame and overhead structure to lift the frame. The design is not conducive to cover the full sides of the watercraft. Since the cover still creates a shadow over the water when the watercraft is off the lift, this design would often be regulated as a canopy or covered moorage vs. a watercraft cover. Driving a swing arm directly from a linear actuator has limitations, since the starting and ending swing arm angles need to be more than 20 degrees in practice since the loads jump exponentially as the angle becomes more shallow. This limits the stroke of the swing arms to be a maximum of 140 degrees, which makes the geometry difficult to uncover the entire boat if the swing arm pivot location is not under the boat. This creates a need for a means of driving a swing arm up to 180 degrees, so the pivot point can be lateral to the watercraft, the starting roller position aft of the boat, and the ending position forward of the boat.

BRIEF DESCRIPTION OF THE SEVERAL VIEWS OF THE DRAWING(S)

DETAILED DESCRIPTION OF THE INVENTION

Figure 1:
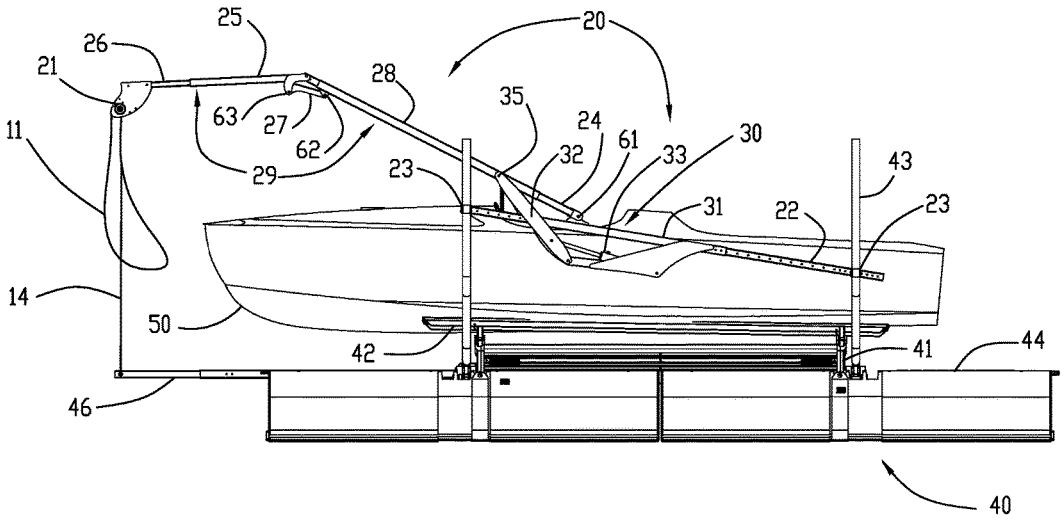
FIG. 1 is a side view of a watercraft on a lift in accordance with an embodiment of the present invention with the cover in an "Off" position with the articulating configuration.

The invention generally relates to a watercraft lift system, generally lifting powerboats under 50 feet long, however, the design could be applied to other type boat and watercraft lift systems and other types of boats and watercraft or boat storage options. The mechanism that actuates a swing arm up to 180 degrees can also be used on a wide variety of vehicles and mechanical devices.

The disclosed embodiments of the invention are illustrated for a watercraft lift that allows for simple installation and removal of the cover, better protection for the watercraft, less view blockage, and better theft prevention. The combination of these features saves the boater time before and after boating, reduces hull cleaning, reduces hull fading, and allows the owner to store equipment, such as water skis inside the watercraft more securely.

As shown in the drawings for purposes of illustration, a watercraft 50 is supported by a watercraft lift 40 using port and starboard (left and right side) watercraft lift bunks 42. However the cover mechanism can be mounted to a dock, dry stack, or the ground. The watercraft lift may use bunks 42, rollers or other means for supporting the watercraft thereon. The watercraft lift 40 shown includes floats 44, guides 43, frame 41.

Port and starboard swing arms 24 are, respectively, pivotally connected to the port and starboard mechanism base 31 at arm pivot 61 (in FIGS. 1-3) and are each simultaneously moved by operation of a corresponding port and starboard follower 32. The upper sections of the swing arm assemblies 29 are connected with a lateral anti-racking bar 38, which provides lateral stability of the cover system 10. In the preferred embodiment, the forward and aft sections of the mechanism base 31 is attached to mount brackets 23 on the forward and aft guides 43.

Figure 6:
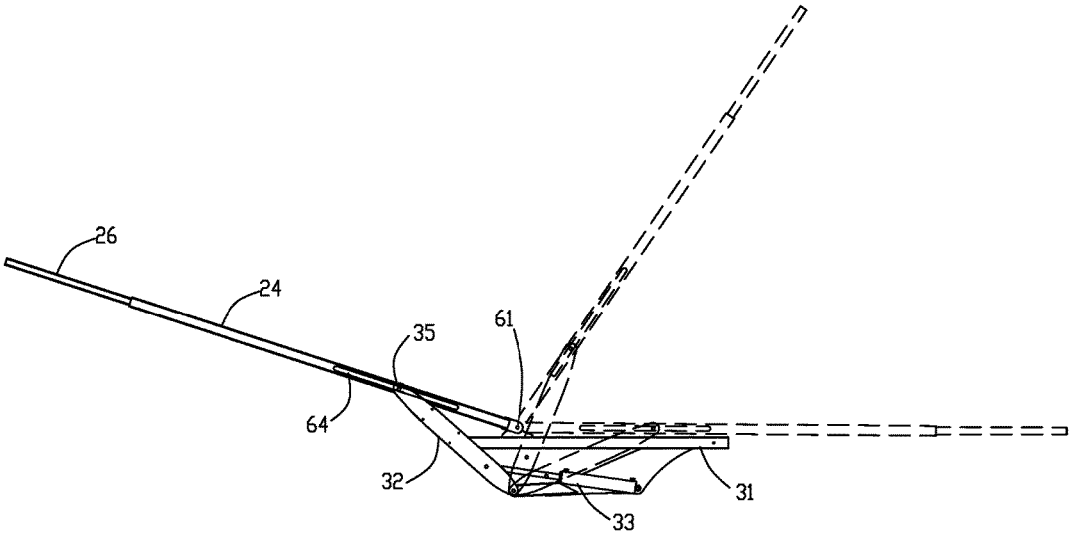
FIG. 6 is a side view of a cover mechanism configuration without articulation.

FIG. 6 shows the non-articulating embodiment, the port and starboard linear actuators 33 have a lower end pivotally connected to the port and starboard mechanism base 31, respectfully, and an upper end pivotally connected to the starboard and port followers 32, respectfully. The upper ends of the port and starboard followers 32 have port and starboard driving pins 35, respectively, which are connected to a slots 64 in the port and starboard swing arm assemblies, respectfully. The lower ends of the port and starboard followers are pivotally connected to the port and starboard mechanism base 31, respectfully. This mechanism enables up to 180 degrees of arm stroke.

Figure 9:
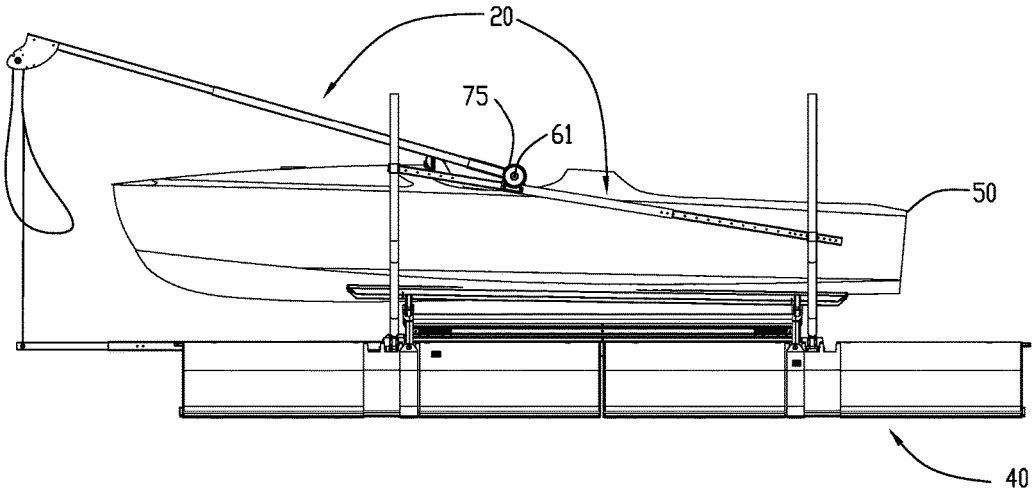
FIG. 9 is a side view of a cover mechanism configuration using a rotary actuator to drive the swing arm.

In another embodiment shown in FIG. 9, the swing arms are actuated with a rotary actuator 75, which applies torque to the port and starboard swing arm assemblies from a mechanism base.

In a preferred embodiment shown in FIG. 1, the cartridge assembly 30, which may include the mechanism base 31, follower 32, linear actuator 33, and swing arm assembly with elongated roller 21, can be more easily adjusted fore and aft with the port and starboard mechanism base 31 telescoping over a port and starboard side rail 22, respectfully.

In a preferred embodiment, shown in FIG. 1, the swing arm can articulate to reduce vertical height. In this embodiment, the port and starboard slider sleeves 28 telescope over the port and starboard lower swing arm 24, respectfully. Anti-friction tape on the inside of the slider sleeves or outside the lower swing arm prevent galling. Port and starboard links 27 are pivotally connected to a lug 62 on the upper end of the port and starboard slider sleeves 28, respectfully. The other end of the port and starboard links are attached to lugs 63 on the lower end of the upper swing arms 25. As the linear actuator 33 pushes the follower 32 in one direction, the swing arm assembly 24 rotates, and the slider sleeve 28 slides on the lower swing arm 24, which moves the link 27 which pivots the upper swing arm 25 relative to the lower swing arm 24 which reduces the elevation of the roller tube 21 over the watercraft compared to if the swing arm 24 did not articulate when operating. This is beneficial for less wind load, and for clearance for overhead roof structures. The articulating arm enables the pivot point of the swing arm to be laterally located to the side of the boat in windy environments, and enables use for larger boats. Not having any cover mechanism under the watercraft elevation enables use on most any watercraft lift, or boat storage.

In a preferred embodiment, the linear actuator is controlled via remote control, and the actuator is a hydraulic cylinder powered by a hydraulic power unit.

In another embodiment, the linear actuator is an electric linear actuator.

In a preferred embodiment, each of the port and starboard upper swing arms 25 includes a telescoping tube 26 telescopically disposed with respect to the upper swing arm portion and by which the length of the swing arm can be selectively adjusted to fit the watercraft 50.

An elongated roller tube 21 extends laterally between and is rotatable relative to the upper end portions of the swing arm assembly 29.

Figure 10:
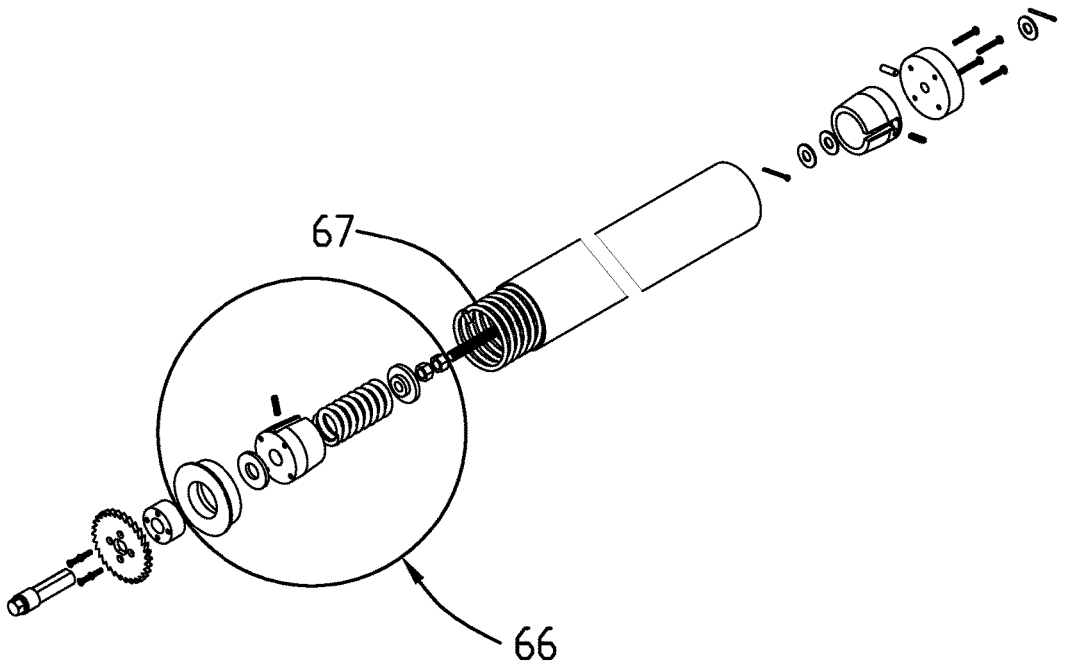
FIG. 10 is an exploded view of elongated roller, showing spring, clutch.

In a preferred embodiment shown in FIG. 10, an internal torsional spring 67 is within a roller tube 26 and applies adjustable rotation force to the roller tube and hence a pulling force to a cover 11 attached thereto.

Figure 13:
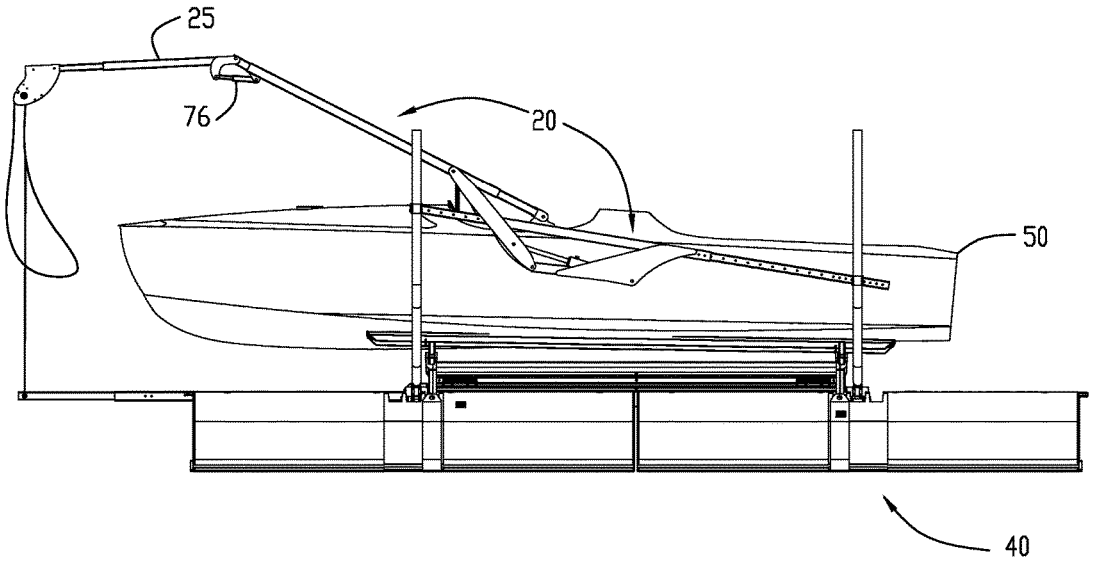
FIG. 13 is a side view of a cover mechanism configuration using a linear actuator to articulate the swing arm.

In an alternative embodiment, shown in FIG. 13, an linear actuator 76 controls the angle of the upper swing arm 25 to the lower swing arm 24.

In a preferred embodiment shown in FIG. 10, a slip clutch 66 prevents the torsional spring 67 from being torqued beyond a predetermined value.

Figure 15:
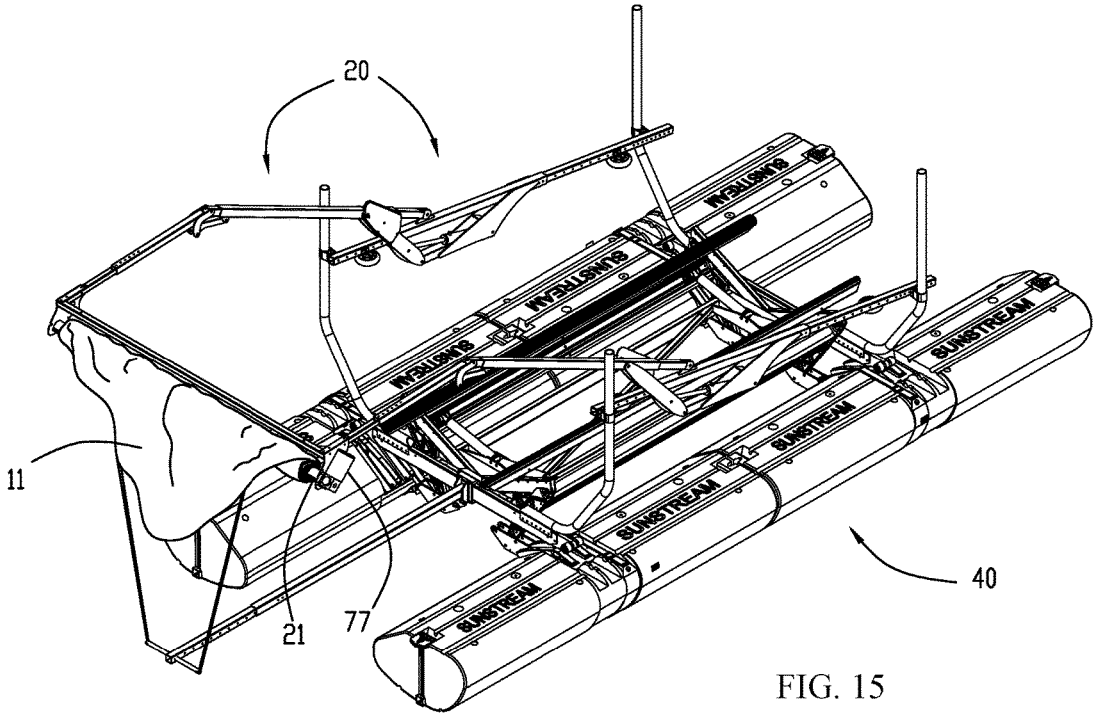
FIG. 15 is an isometric view of a cover mechanism configuration using a motor to apply torsion to the elongated roller.

In an alternative embodiment shown in FIG. 15, an electric or hydraulic roller motor 77 is used to apply torque from the telescoping tube 26 to the roller tube 21. An alternative embodiment without the articulating upper swing arm 25, slider sleeve 28 or link 27 is shown in FIG. 6, with the telescoping tube 26 inserted into the lower swing arm 24 instead of the upper swing arm 25, shown in FIG. 6.

Figure 3:
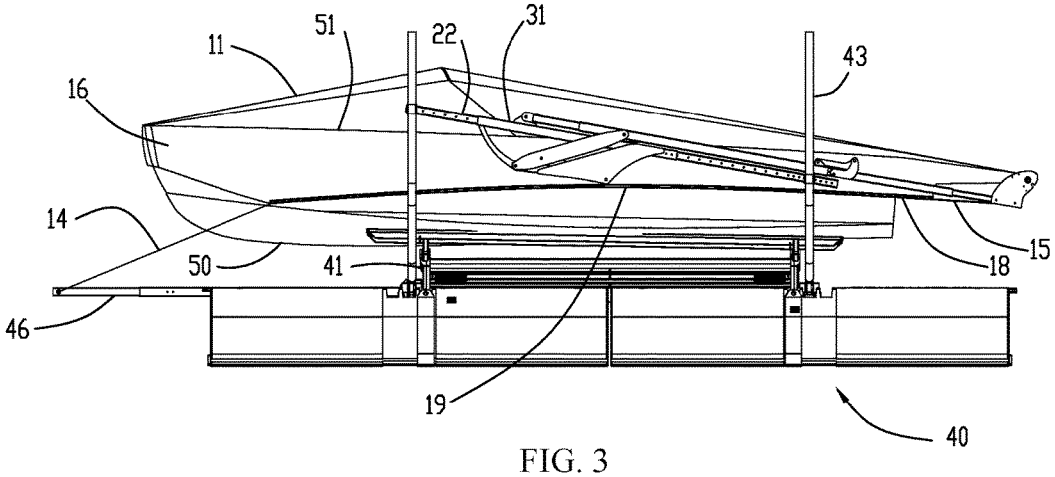
FIG. 3 is a side view of the watercraft on the lift with cover in an "On" position with the articulating configuration.

In a preferred embodiment shown in FIG. 3, the front of the cover 11 has a bow pocket 16 sized to accept therein the bow of the watercraft 50 when the cover is deployed to cover the watercraft. A forward cover line 14 extends between the front wings 13 of the cover and a forward end portion of a bow sprit 46 which has a rearward end portion attached to the watercraft lift frame 41 of the watercraft lift 40. In the preferred embodiment, the bow sprit 46 has a spreader bar 47 to position the forward cover lines so the cover can more easily slide over the watercraft rub rail forward shoulders 51. Another embodiment secures the forward cover lines to the dock in front of the watercraft. Another embodiment secures the front of the cover to a front cover support 48 in front of the bow so a bow pocket 16 and forward cover lines 14 are not needed.

Figure 4:
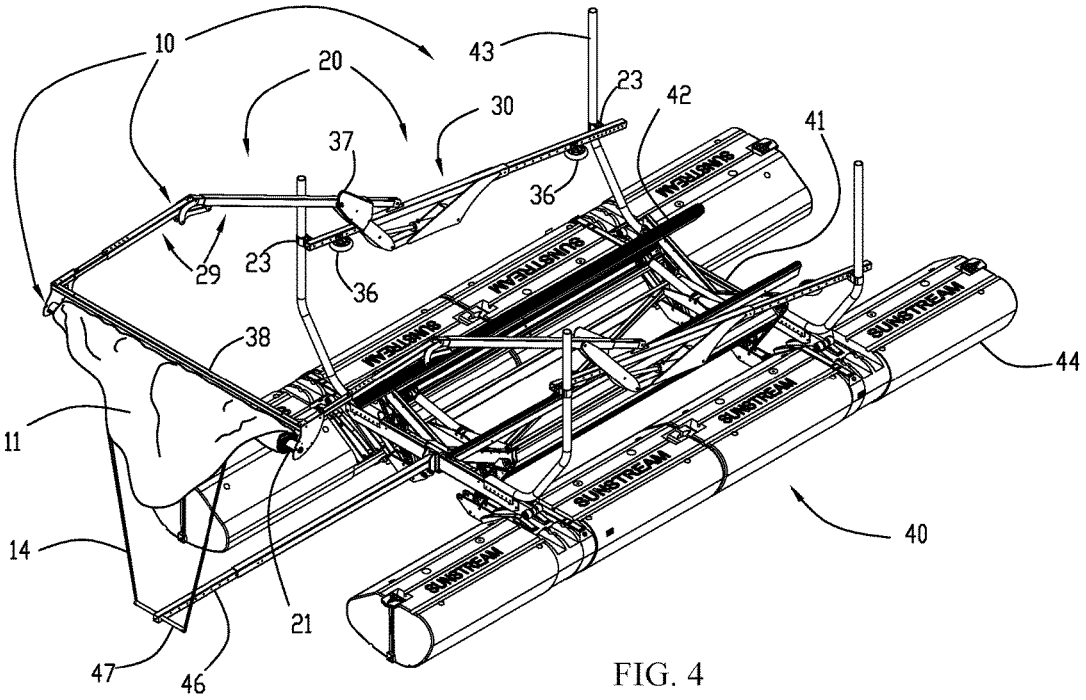
FIG. 4 is an isometric view of the lift and cover without a watercraft with the articulating configuration.
Figure 5:
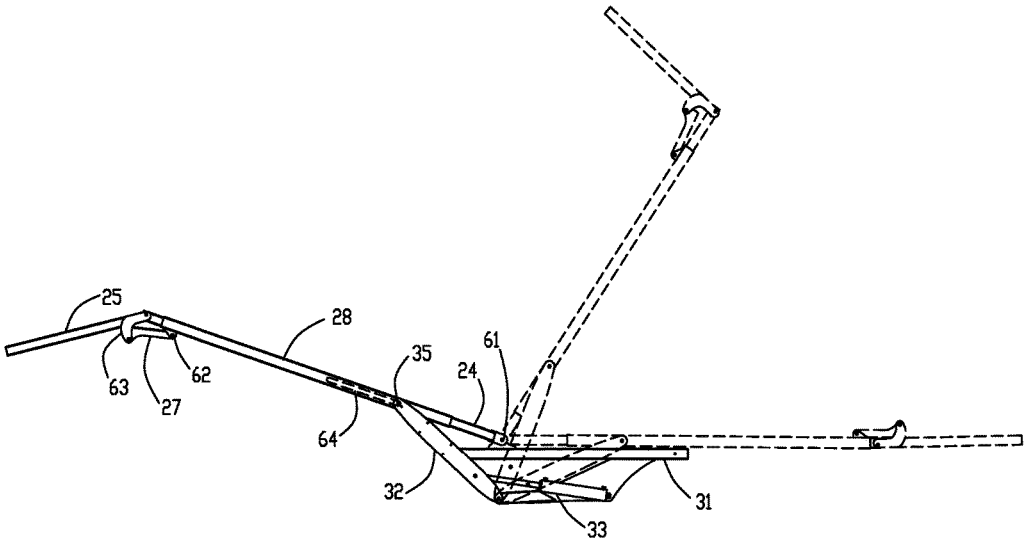
FIG. 5 is an enlarged view of the cover mechanism with articulating configuration

The watercraft 50 is protected from the cover system 10 with rollers 36 mounted on the side rails 22, and with a port and starboard guide plates 37 mounted to the inboard port and starboard followers 32, respectfully, shown in FIG. 4. The guide plate is constructed with a flexible material, such as plastic, and cantilevers beyond the follower 32 so it will not cause damage to the rub rail of the watercraft 50 when operating cover system 10. Additional guide wheels 36 can also be added for protecting the watercraft when loading.

Figure 11:
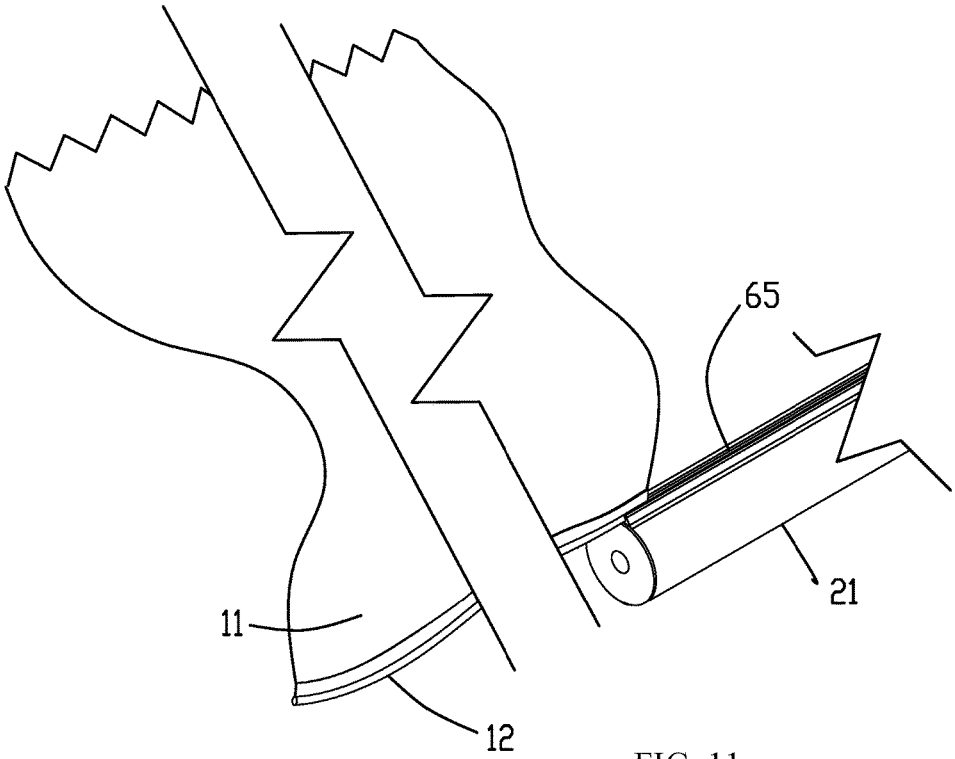
FIG. 11 is an isometric view of an elongated roller track and cover keder bead.
Figure 12:
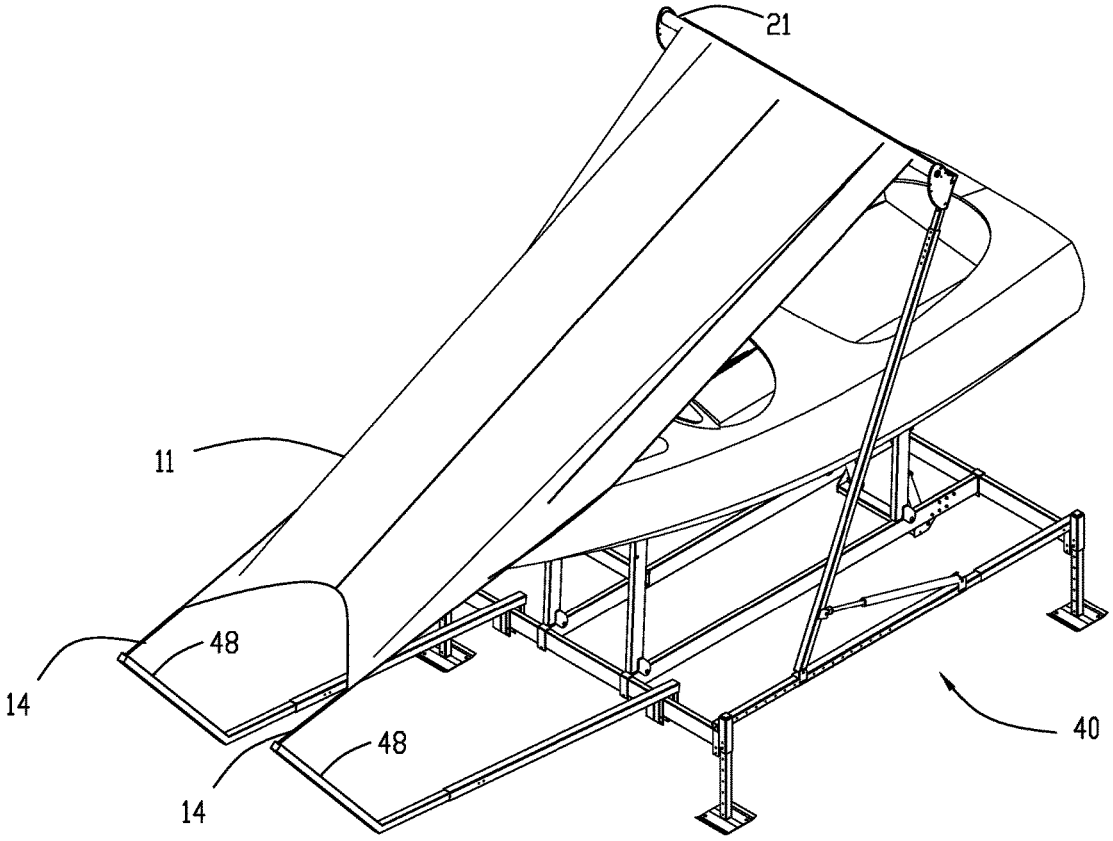
FIG. 12 is an isometric view of a cover mechanism configuration of the front of the cover being supported by front cover support.

The cover 11 is uniquely designed to operate with the cover system. The cover is shaped to fit the watercraft and cover most the sides. The aft end of the cover is straight and has a keder bead 12 shape sewn into the cover that indexes into a track 65 on the elongated roller 21 to secure the cover to the elongated roller, shown in FIG. 11. The perimeter of the cover 11 has a perimeter pocket 18, shown in FIG. 3 with an elastic cord 15 extending through. When the cover is fully deployed on watercraft 50, the elastic is tightened by being wrapped around the roller tube 21 in the opposite direction than the cover for the first few wraps so that the elastic cord 15 is tensioned when the roller tube is pulled aft, and is loosened when roller tube moves forward and the cover begins to be rolled up on the roller tube.

Figure 2:
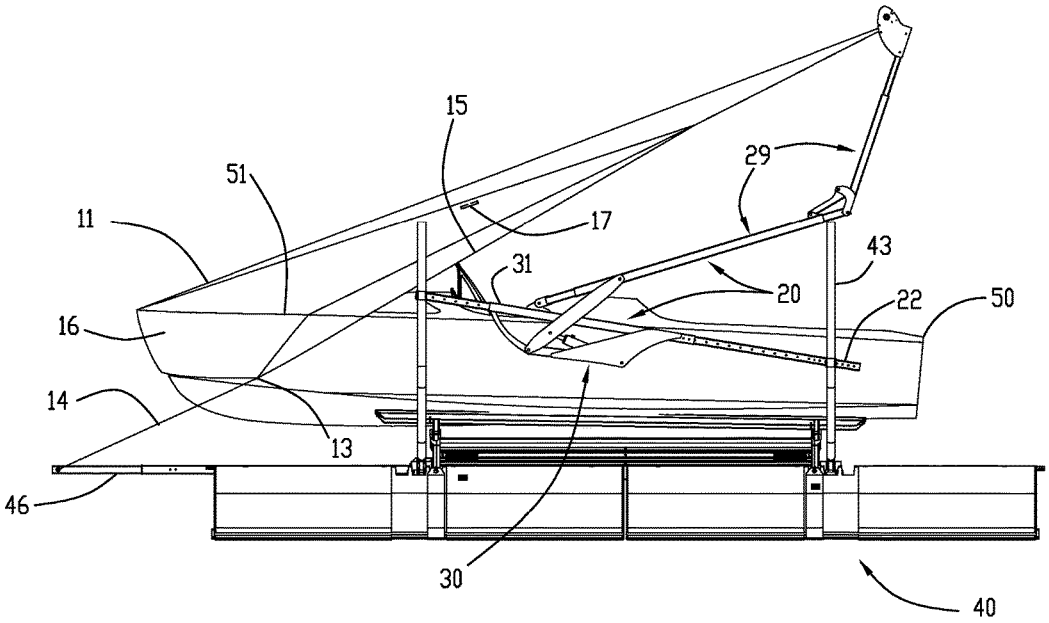
FIG. 2 is a side view of the watercraft on the lift with cover in a "Partially On" position with the articulating configuration.

The preferred embodiment of the cover 11 has forward side wings 13 near the forward shoulder of the watercraft rub rails 51 which are designed to better secure the cover to the sides of the watercraft and to prevent the cover from being stopped on the forward shoulders of the watercraft rub rail 51. The preferred embodiment has the forward lines 14 configured so they are generally pointing toward the watercraft rub rail forward shoulders 51 when the cover is sliding over the watercraft rub rail forward shoulders 51, as shown in FIG. 2. The aft end of the cover 11 is attached to the roller tube 21 with the cover end sliding into a lateral track on the roller, shown in FIG. 11.

A preferred embodiment designs the cover 11 with a slight catenary curve 19 which pulls the center of the cover tight laterally as the elastic cord 15 is tightened, shown in FIG. 3.

A preferred embodiment includes at least one control handle 17, shown in FIG. 2 inside the cover toward the forward end of the cover to assist positioning the cover if needed, and is sometimes needed in certain wind conditions.

Figure 7:
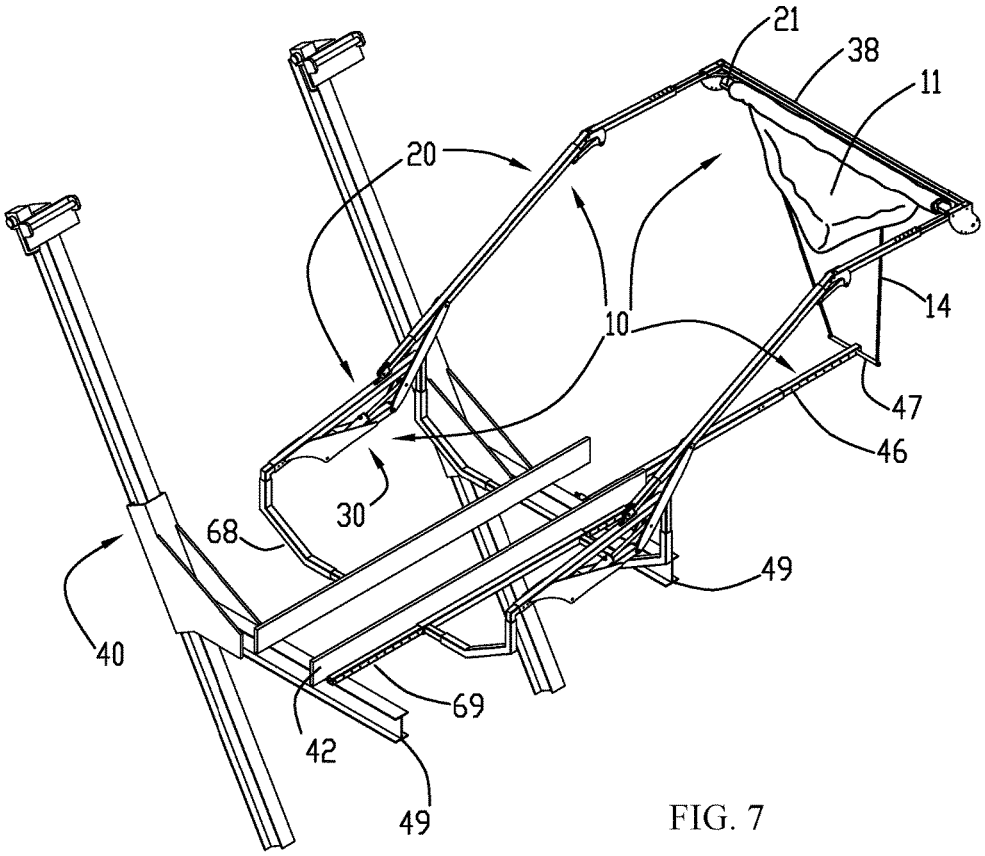
FIG. 7 is an isometric view of a cover mechanism configuration for partial side loading.

Another embodiment, shown in FIG. 7, allows for improved access for loading the watercraft when approaching the lift at a steep angle, which is common for watercraft lifts side mounted in canals. In this embodiment, there is no outboard rear guide 43. Instead, longitudinal beams 69 spanning from the forward and aft lateral beams 49 of the watercraft lift 40, located parallel and outboard of the watercraft lift bunks 42.

Figure 8:
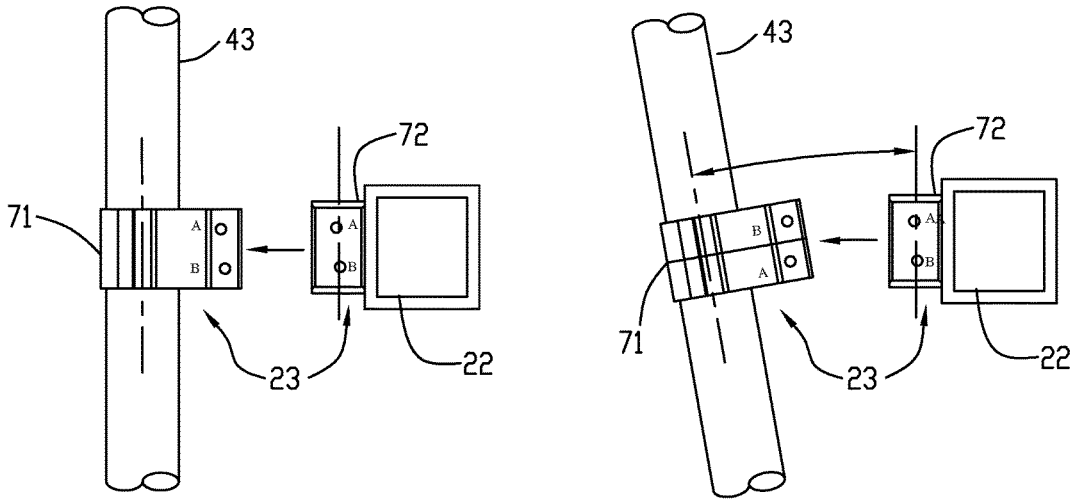
FIG. 8 is an enlarged view of the reversible mounting bracket showing two angle options.

Another embodiment enables the side rail 22 to be installed on an upright watercraft guide 43, or one on a slight angle, shown in FIG. 8. The at least two part bracket 23 is configured such that if one part is installed in an opposite direction, the angle of installation changes. The two parts of the brackets include a clamp 71, which secures to a watercraft guide or other upright member, and a reversible block 72, with a first and second side.

Figure 14:
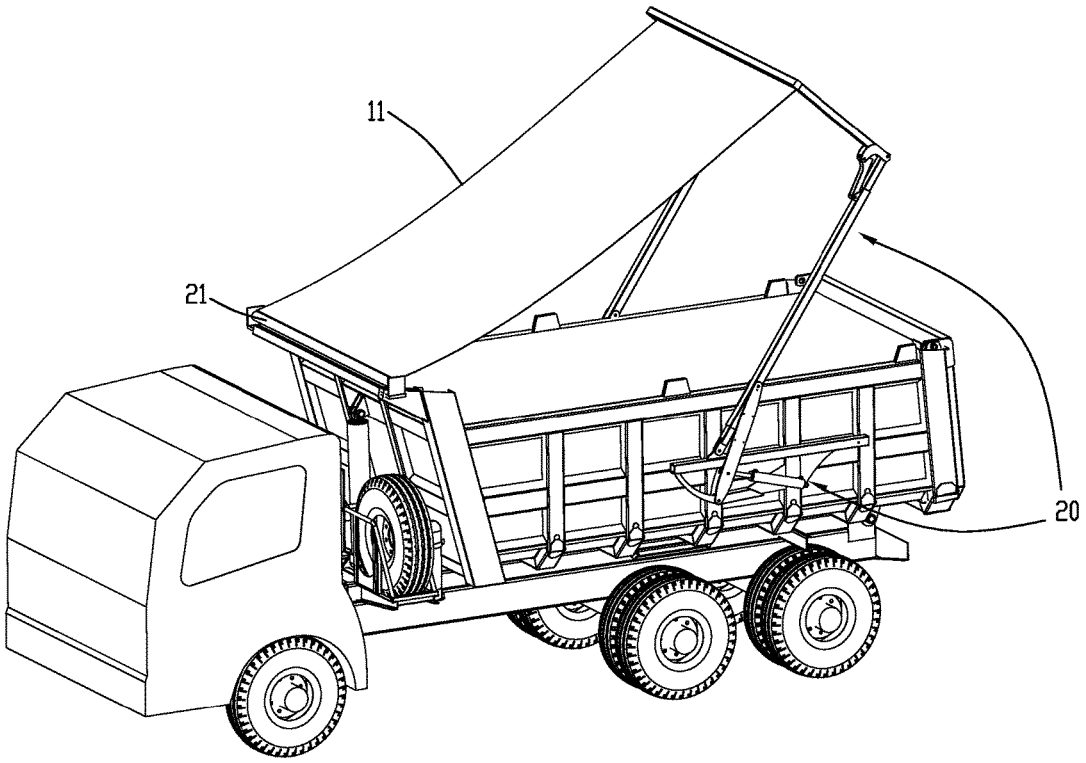
FIG. 14 is an isometric view of a cover mechanism configuration where the roller is fixed and the cover end is pulled by the swing arms.

Another embodiment attaches the cover system to a dock, watercraft trailer, the ground, or watercraft storage stand. Another embodiment has the mechanism and cover reversed to the depiction, with the roller in the front when the cover is on. Another embodiment uses the mechanism 20 other than as a boat covers, such as for covering dump trucks, shown in FIG. 14. Another embodiment uses the mechanism for uses besides with covers.

10 Cover system
11 Cover
12 Keder bead
13 Forward wing of cover
14 Forward cover line
15 Elastic cord
16 Bow pocket
17 control handle
18 Perimeter pocket
19 Side catenary of cover
20 Cover mechanism
21 Elongated Roller
22 Side rail
23 Mount bracket
24 Lower Swing arm
25 Upper swing arm
26 Telescoping tube
27 Link
28 Slider sleeve
29 Swing arm assay
30 Cartridge assembly
31 mechanism base
32 Follower
33 Linear Actuator
35 Driving pin
36 Guide wheels
37 Guide plates
38 Anti-racking bar
40 Watercraft lift
41 Watercraft Lift frame
42 Watercraft Lift bunks
43 Watercraft lift guides
44 Watercraft Lift Floats
46 Bow sprit
47 Spreader bar
48 Front Cover support
49 Lateral beam of watercraft lift
50 Watercraft
51 Watercraft rub rail forward shoulders
61 Lower arm pivot
62 Slider sleeve lug
63 Upper swing arm lug
64 Swing arm slot
65 Elongated roller track
66 Slip clutch
67 Torsional Spring
68 Connecting member
69 Longitudinal beam

71 Clamp
72 Reversible block
75 Rotary actuator
76 Swing arm linear actuator
77 Roller motor From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A watercraft covering apparatus attachable to a watercraft lift frame having a first upright member and a second upright member spaced apart from the first upright member, and adapted for supporting a watercraft having a watercraft first end portion and a watercraft second end portion, and watercraft lateral sides, the watercraft covering apparatus comprising:

at least one mechanism base with a mechanism first end portion and a mechanism second end portion, the mechanism base being located outboard of at least one of the watercraft lateral sides when the watercraft is supported by the frame, the mechanism first end portion being connectable to the first upright member and the mechanism second end being connectable to the second upright member;

at least one swing arm having a swing arm lower end portion pivotally attached to the mechanism base and a swing arm upper end portion, the swing arm having a swing arm longitudinal slot, the swing arm being pivotable between a swing arm first position whereat the swing arm upper end portion is positioned proximate to the watercraft first end portion when the watercraft is supported by the frame and a swing arm second position whereat the swing arm upper end portion is positioned proximate to the watercraft second end when the watercraft is supported by the frame, when in the swing arm second position the swing arm is more than 140 degrees from the swing arm when in the swing arm first position;

a driving pin connected to the swing arm longitudinal slot;

a follower member with a follower member lower end portion pivotally connected to the mechanism base and a follower member upper end portion connected to the driving pin such that when the follower member is in a follower member first position the swing arm is in the swing arm first position, and when the follower member is in a follower member second position the swing arm is in the swing arm second position;

at least one actuation member having an actuation member first end portion pivotally connected to the mechanism base and an actuation member second end portion connected to the follower member;

an elongated roller having an end portion rotatably supported by the swing arm upper end portion for travel with the swing arm upper end portion as the swing arm is pivotally moved between the swing arm first position and the swing arm second position;

a watercraft cover with a watercraft cover first end and a watercraft cover second end, the cover first end being attached to a securing member, and the cover second end being attached to the elongated roller, the watercraft cover being substantially fully wound about the elongated roller when the swing arm is in the swing arm first position, the watercraft cover being sized to lengthwise extend over and cover the watercraft when the swing arm is move to the swing arm second position and the watercraft is supported by the frame; and a torsion member configured so that the elongated roller is rotated in a first rotational direction when the swing arm is moved to the swing arm first position and rotated in the opposite rotational direction when the swing arm is moved to the swing arm second position, the torsion member providing sufficient torque to roll the cover on the elongated roller.

2. The watercraft covering apparatus of claim 1, further including a guide plate mounted on a side of the follower member at a side toward the watercraft when the watercraft is supported by the frame, the guide plate being constructed of a flexible material and extending beyond at least one edge of the follower member to allow for deflection to avoid damage to the watercraft when the swing arm is moved between the swing arm first position and the swing arm second position.

3. The watercraft covering apparatus of claim 1, wherein the swing arm is comprised of at least a lower swing arm member and an upper swing arm member, the lower swing arm member including a slider sleeve upper portion in telescoping relation with a slider sleeve lower portion, the slider sleeve upper portion including an upper portion pivotally connected to the upper swing arm member and a lower portion, with the drive pin being pivotally connected to the lower portion of the slider sleeve upper portion, the watercraft covering apparatus further including a first lug, a second lug and a link member, the first lug being attached to a side of the upper portion of the slider sleeve upper portion, the second lug being attached to the same side of the upper swing arm member, and the link being pivotally connected to both the first lug and the second lug, the link having holes within which the first and second lugs are positioned such that the angle between the upper swing arm member and lower swing arm member changes relative to one another when the lower arm member pivots.

4. The watercraft covering apparatus of claim 3, wherein the upper swing arm member is comprised of at least two telescoping tubes that can be secured in multiple extended positions relative to each other to adjust the length of the upper swing arm member.

5. The watercraft covering apparatus of claim 3, wherein the watercraft cover has a first attachment member having a first attachment member first end portion attached to the watercraft cover first end and a first attachment member second end portion attachable to the frame, and the watercraft cover first end has a pocket positionable over the watercraft first end portion to secure the watercraft cover to the watercraft first end portion and cover the watercraft first end portion.

6. The watercraft covering apparatus of claim 1, wherein the swing arm is comprised of at least a lower swing arm member and an upper swing arm member, the lower swing arm member being pivotally connected to the upper swing arm member, the watercraft covering apparatus further including a linear actuator pivotally connected to the lower swing arm member and the upper swing arm member such that angle between the lower swing arm member and upper swing arm member is changed by extension of the linear actuator.

7. The watercraft covering apparatus of claim 1, wherein the swing arm is comprised of a lower swing arm member and an upper swing arm member, the upper swing arm member being comprised of at least two telescoping tubes that can be secured in multiple extended positions relative to each other to adjust the length of the upper swing arm member.

8. The watercraft covering apparatus of claim 1, wherein the mechanism first end portion has an end and is connected to the first upright member at a position spaced away therefrom, and the mechanism second end portion has an end and is connected to the second upright member at a position spaced away therefrom, the mechanism base includes a first reversible bracket located between the end of the mechanism first end portion and the first upright member, and a second reversible bracket located between the end of the mechanism second end portion and the second upright member, each of the first and second reversible brackets has at least two holes arranged such that by reversing the bracket the mounting angle between the mechanism base and the first and second upright members can be adjusted.

9. The watercraft covering apparatus of claim 1, wherein the mechanism base comprises a movable cartridge and a fixed side rail, the movable cartridge including the actuation member, the follower member, and a pivot by which the swing arm is pivotally attached to the mechanism base.

10. The apparatus of claim 1, wherein the torsion member is a rotational roller motor.

11. The apparatus of claim 1, further including an internal torsional spring positioned within the elongated roller to apply torque to the elongated roller to roll up the watercraft cover as the swing arm moves in one direction, and deploy the watercraft cover as the swing arm moves in an opposite direction, and a slip clutch that slips if the torque applied to the spring exceeds a set amount.

12. The watercraft covering apparatus of claim 1, wherein the mechanism base is a side rail.

13. A watercraft covering apparatus connectable to a watercraft lift frame, and adapted for supporting a watercraft having a watercraft first end portion and a watercraft second end portion, and watercraft lateral sides, the watercraft covering apparatus comprising:

at least one mechanism base with a mechanism first end portion and a mechanism second end portion, the mechanism base being connectable to the frame at a located outboard of at least one of the watercraft lateral sides when the watercraft is supported by the frame;

at least one swing arm having a swing arm lower end portion pivotally attached to the mechanism base and a swing arm upper end portion, the swing arm having a swing arm longitudinal slot, the swing arm being pivotable between a swing arm first position whereat the swing arm upper end portion is positioned proximate to the watercraft first end portion when the watercraft is supported by the frame and a swing arm second position whereat the swing arm upper end portion is positioned proximate to the watercraft second end when the watercraft is supported by the frame, when in the swing arm second position the swing arm is more than 140 degrees from the swing arm when in the swing arm first position;

a driving pin connected to the swing arm longitudinal slot;

a follower member with a follower member lower end portion pivotally connected to the mechanism base and a follower member upper end portion connected to the driving pin such that when the follower member is in a follower member first position the swing arm is in the swing arm first position, and when the follower member is in a follower member second position the swing arm is in the swing arm second position;

at least one actuation member having an actuation member first end portion pivotally connected to the mechanism base and an actuation member second end portion connected to the follower member;

an elongated roller having an end portion rotatably supported by the swing arm upper end portion for travel with the swing arm upper end portion as the swing arm is pivotally moved between the swing arm first position and the swing arm second position;

a watercraft cover with a watercraft cover first end and a watercraft cover second end, the cover first end being attached to a securing member, and the cover second end being attached to the elongated roller, the watercraft cover being substantially fully wound about the elongated roller when the swing arm is in the swing arm first position, the watercraft cover being sized to lengthwise extend over and cover the watercraft when the swing arm is move to the swing arm second position and the watercraft is supported by the frame; and a torsion member configured so that the elongated roller is rotated in a first rotational direction when the swing arm is moved to the swing arm first position and rotated in the opposite rotational direction when the swing arm is moved to the swing arm second position, the torsion member providing sufficient torque to roll the cover on the elongated roller.

* * * * *